US008602796B2

(12) United States Patent
Chin et al.

(10) Patent No.: US 8,602,796 B2
(45) **Date of Patent: *Dec. 10, 2013**

(54) ELECTRICAL PLUG CONNECTOR, ELECTRICAL SOCKET CONNECTOR, ELECTRICAL PLUG AND SOCKET CONNECTOR ASSEMBLY

(75) Inventors: Hsien-Ning Chin, Taoyuan County (TW); Kun-Shen Wu, Taoyuan County (TW)

(73) Assignee: Aces Electronic Co., Ltd., Taoyuan County (TW)

( * ) Notice: Subject to any disclaimer, the term of this patent is extended or adjusted under 35 U.S.C. 154(b) by 9 days.

This patent is subject to a terminal disclaimer.

(21) Appl. No.: 13/529,631

(22) Filed: Jun. 21, 2012

(65) Prior Publication Data

US 2013/0052881 A1 Feb. 28, 2013

(30) Foreign Application Priority Data

Aug. 26, 2011 (TW) ..... 100216031 U

(51) Int. Cl.
*H01R 12/00* (2006.01)

(52) U.S. Cl.
USPC ..... 439/79; 439/825

(58) Field of Classification Search
USPC ..... 439/682, 78, 79, 660, 507, 825, 907, 439/947
See application file for complete search history.

(56) References Cited

U.S. PATENT DOCUMENTS

| | | | | |
|---|---|---|---|---|
| 5,139,426 | A * | 8/1992 | Barkus et al. | 439/65 |
| 5,158,471 | A * | 10/1992 | Fedder et al. | 439/80 |
| 6,203,335 | B1 * | 3/2001 | Chang | 439/79 |
| 6,471,523 | B1 * | 10/2002 | Shuey | 439/63 |
| 6,776,635 | B2 * | 8/2004 | Blanchfield et al. | 439/181 |
| 6,780,027 | B2 * | 8/2004 | Allison | 439/79 |
| 6,814,590 | B2 * | 11/2004 | Minich et al. | 439/79 |
| 6,832,931 | B1 * | 12/2004 | Wu | 439/499 |
| 6,848,950 | B2 * | 2/2005 | Allison et al. | 439/682 |
| 7,001,189 | B1 * | 2/2006 | McGowan et al. | 439/79 |
| 7,104,812 | B1 * | 9/2006 | Bogiel et al. | 439/79 |
| 7,905,731 | B2 * | 3/2011 | Ngo et al. | 439/75 |
| 8,096,814 | B2 * | 1/2012 | Schell et al. | 439/79 |

* cited by examiner

*Primary Examiner* — Neil Abrams
*Assistant Examiner* — Phuongchi T Nguyen
(74) *Attorney, Agent, or Firm* — Muncy, Geissler, Olds & Lowe, PLLC

(57) ABSTRACT

In an electrical plug and socket connector assembly, each conducting terminal of each of the electrical plug connector and electrical socket connector defines two side panels spaced by a gap, a connection portion connected between one end of each of the two side panels, and two contact end portions respectively forwardly extended from respective opposite ends of the two side panels. Subject to the design of the connection portion, the contact end portions of each conducting terminal of the electrical plug connector can be kept in positive contact with the inner surfaces of the contact end portions and side panels of the mating conducting terminal of the mating electrical socket connector, lowering the impedance and temperature, smoothing conduction of power supply and assuring a high level of safety.

6 Claims, 13 Drawing Sheets

ELECTRICAL PLUG CONNECTOR, ELECTRICAL SOCKET CONNECTOR, ELECTRICAL PLUG AND SOCKET CONNECTOR ASSEMBLY

This application claims the priority benefit of Taiwan patent application number 100216031, filed on Aug. 26, 2011.

BACKGROUND OF THE INVENTION

1. Field of the Invention

The present invention relates to electrical connector technology and more particularly, to an electrical plug and socket connector assembly, which effectively lowers conducting terminal contact impedance and temperature, smoothing conduction of power supply and assuring a high level of safety.

2. Description of the Related Art

When designing an electrical connector for joining electrical circuits, a designer will pay attention to the two basic parts, i.e., signal and power supply. When designing a signal circuit, a designer normally will not consider the factor of current variation for the reason that the applied current is normally low. However, with respect to the transmission of signals, a designer usually will consider the nature of the carrier (high frequency, low frequency) and many other factors (static interference, magnetic interference, impedance matching, etc.) without taking the factor of temperature into account. With respect to power supply, conducting a high-current power supply through a power circuit will increase the impedance, causing a rise in temperature. Thus, when designing an electrical power connector for joining power circuits, the factors of quick heat dissipation and low conducting terminal impedance must be considered, avoiding a significant change in the electrical characteristics. When the conducting terminals of an electrical plug connector and the conducting terminals of a mating electric socket connector are connected, the impedance thus created, the material of the conducting terminals and the contact area between the respective conducting terminals will cause temperature rise and power loss.

FIGS. 12 and 13 illustrate a conducting terminal for electrical plug connector and a mating conducting terminal for electrical socket connector according to the prior art. According to this prior art design, each conducting terminal A comprises two side panels A1 spaced by a gap A11, two end contact portions A2 respectively forwardly extended from the side panels A1, a plurality of connection portions A3 transversely connected between the top edges of the side panels A1, and a plurality of bonding pegs A4 respectively downwardly extended from the respective bottom edges of the side panels A1. In the conducting terminal for electrical socket connector, the connection portions A3 transversely connected between the top edges of the side panels A1 and the top edges of the end contact portions A2. Further, a receiving space A21 is defined between the two contact end portions A2 of the conducting terminal A for electrical socket connector for receiving the mating conducting terminal for electrical plug connector.

According to the aforesaid prior art design, the connection portions A3 are transversely connected between the top edges of the side panels A1 (or between the top edges of the side panels A1 and the top edges of the end contact portions A2). When bending (or stamping) a metal sheet material into shape during a conducting terminal fabrication process, the end contact portions A2 may be not well maintained in parallel. Thus, when the conducting terminal for electrical plug connector is inserted into the conducting terminal for electrical socket connector, the produced contact stress cannot be evenly distributed through the side panels A1, and the end contact portions A2 of the conducting terminal for electrical plug connector cannot be fully kept in contact with the end contact portions A2 of the conducting terminal for electrical socket connector, affecting power transmission quality and causing power loss. The aforesaid prior art connectors are normally used in power supply equipments and server equipments. A small power loss of each power connector in a server equipment results in a large server room power loss.

Therefore, it is desirable to provide an improved design of electrical plug and socket connector assembly, which eliminates the drawbacks of the aforesaid prior art design.

SUMMARY OF THE INVENTION

The present invention has been accomplished under the circumstances in view. It is therefore the main object of the present invention to provide an electrical plug and socket connector assembly, which effectively lowers conducting terminal contact impedance and temperature, smoothing conduction of power supply and assuring a high level of safety.

To achieve this and other objects of the present invention, an electrical plug and socket connector assembly comprises an electrical plug connector and an electrical socket connector. The electrical plug connector and the electrical socket connector each comprise an electrically insulative housing and a plurality of conducting terminals mounted in the electrically insulative housing. Each conducting terminal comprises two side panels spaced by a gap, a connection portion connected between one end of each of the two side panels, and two contact end portions respectively forwardly extended from respective opposite ends of the two side panels. Subject to the design of the connection portion, the contact end portions of each conducting terminal of the electrical plug connector can be kept in positive contact with the inner surfaces of the contact end portions and side panels of the mating conducting terminal of the mating electrical socket connector, lowering the impedance and temperature, smoothing conduction of power supply and assuring a high level of safety.

DETAILED DESCRIPTION OF THE PREFERRED EMBODIMENT

Figure 1:
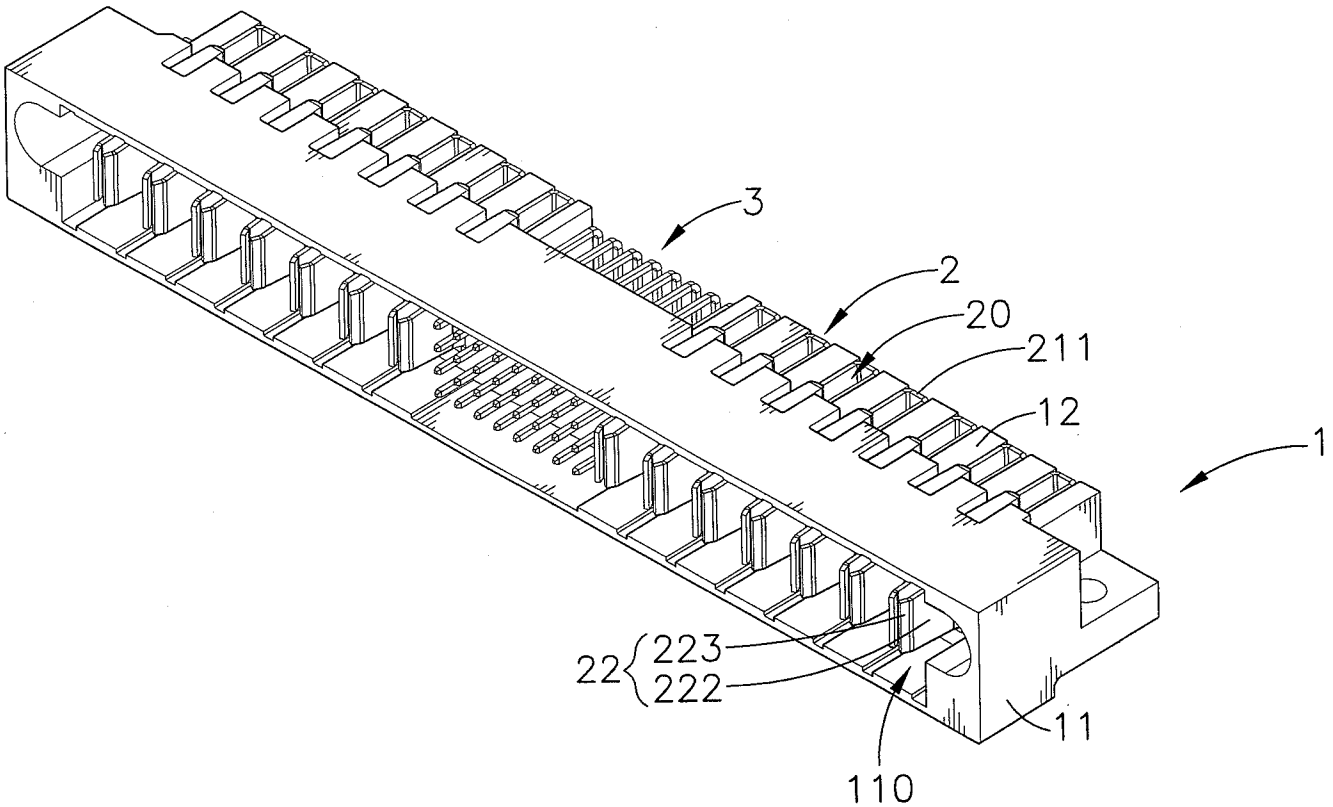
FIG. 1 is an elevational view of an electrical plug connector in accordance with the present invention.
Figure 2:
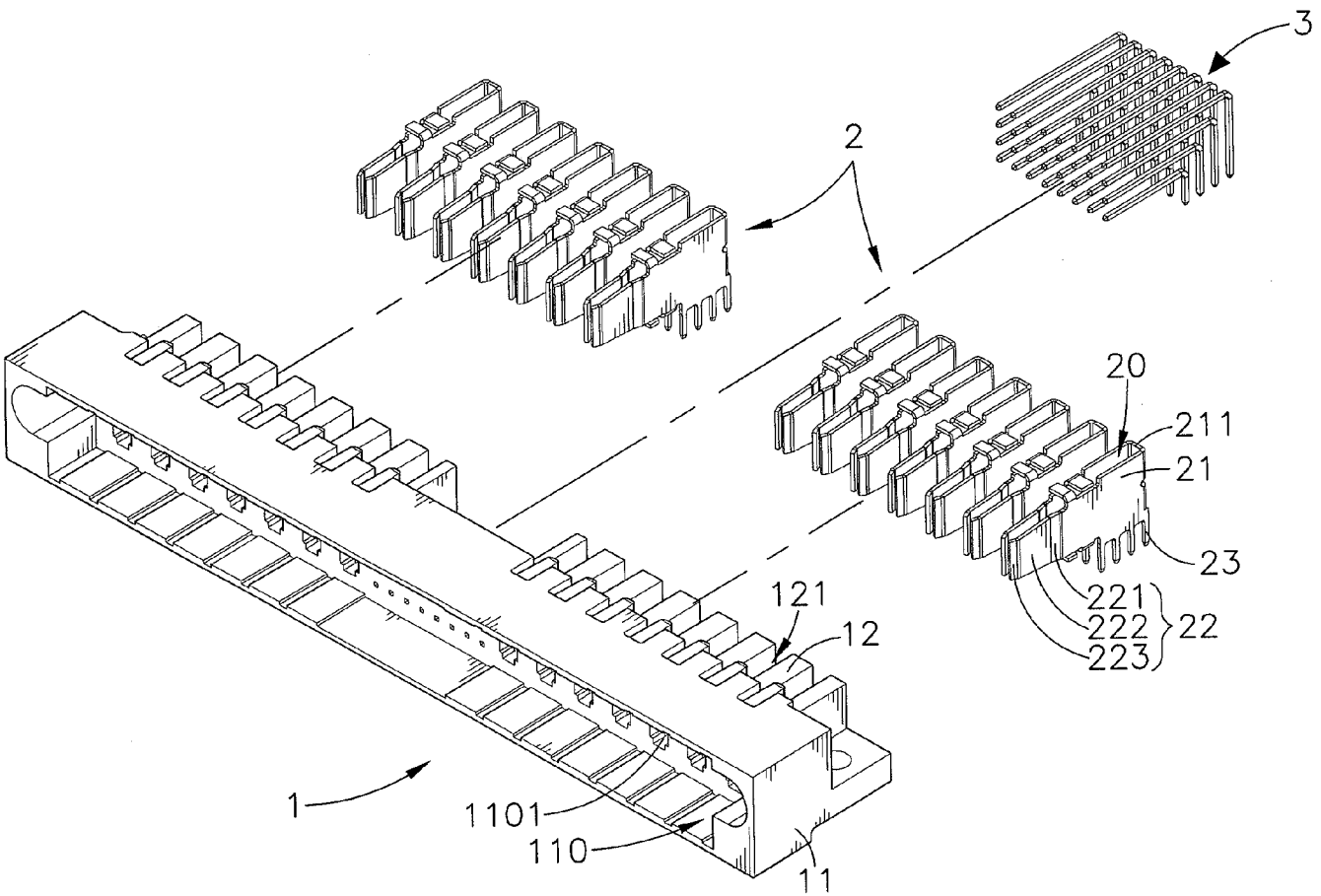
FIG. 2 is an exploded view of the electrical plug connector in accordance with the present invention.
Figure 3:
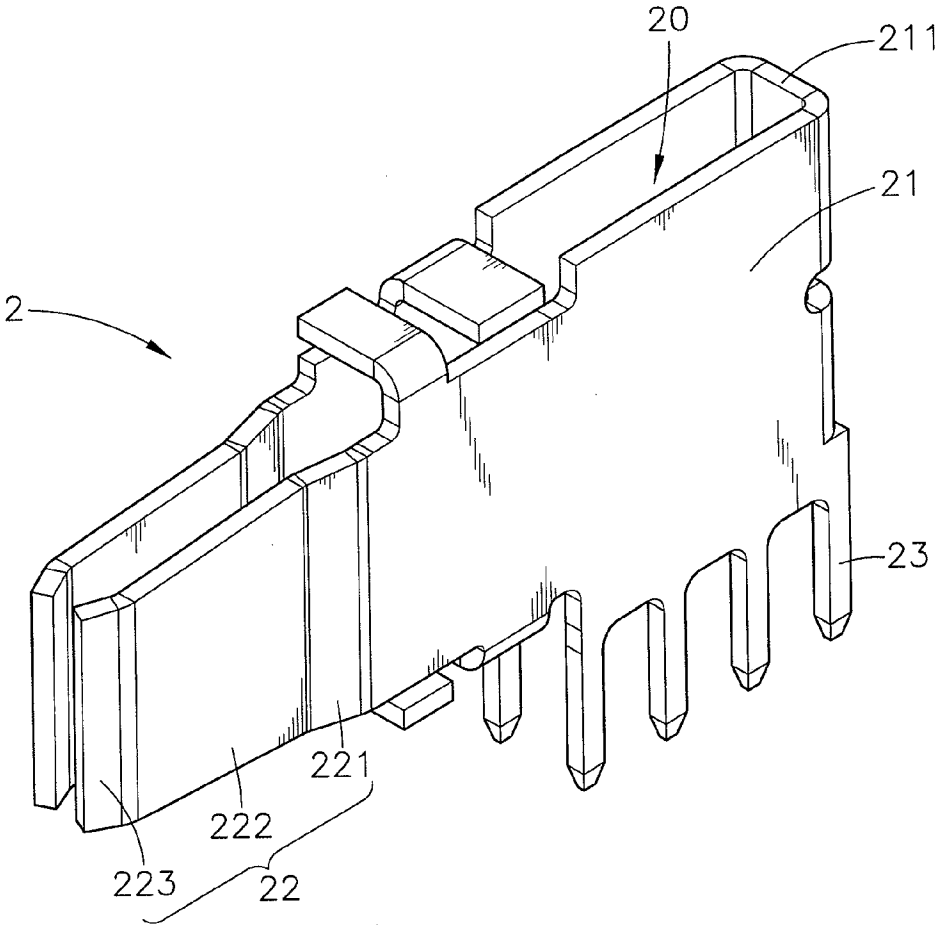
FIG. 3 is an elevational view of one conducting terminal used in the electrical plug connector in accordance with the present invention.
Figure 4:
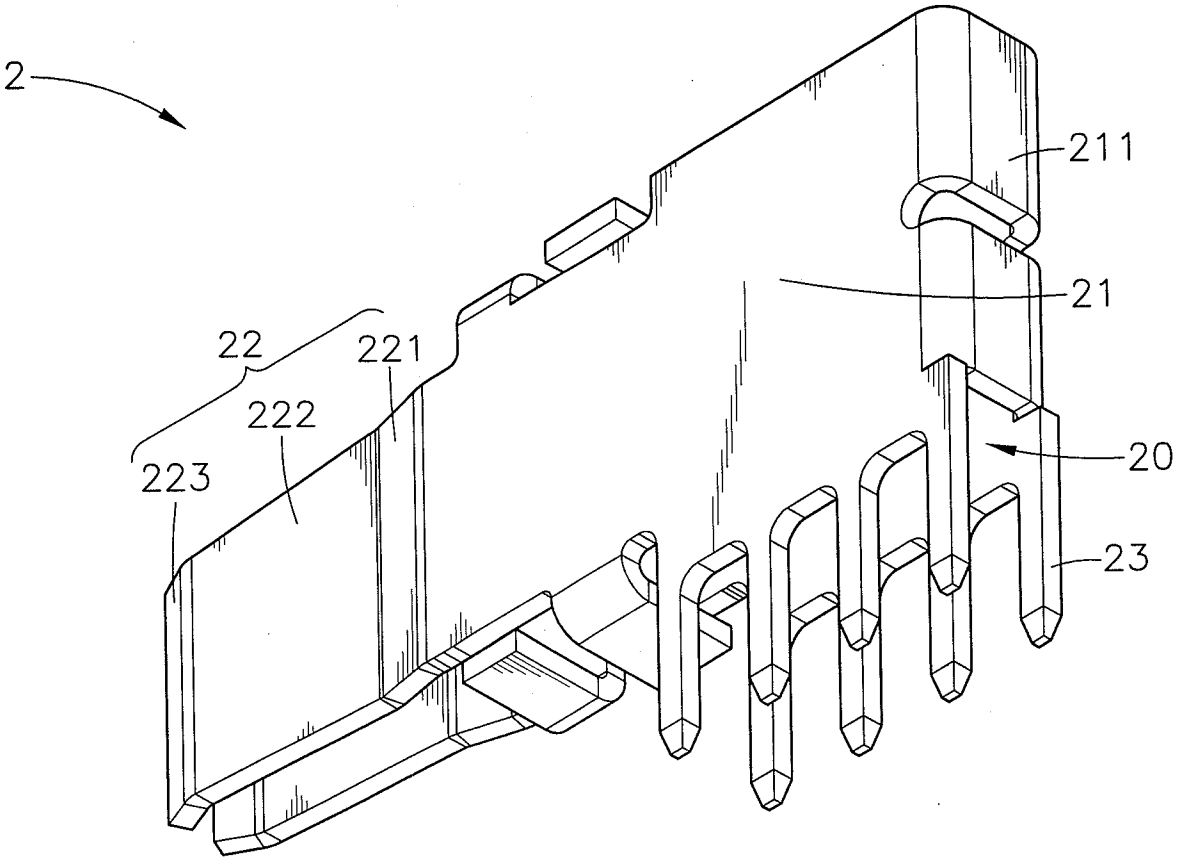
FIG. 4 corresponds to FIG. 3 when viewed from another angle.
Figure 5:
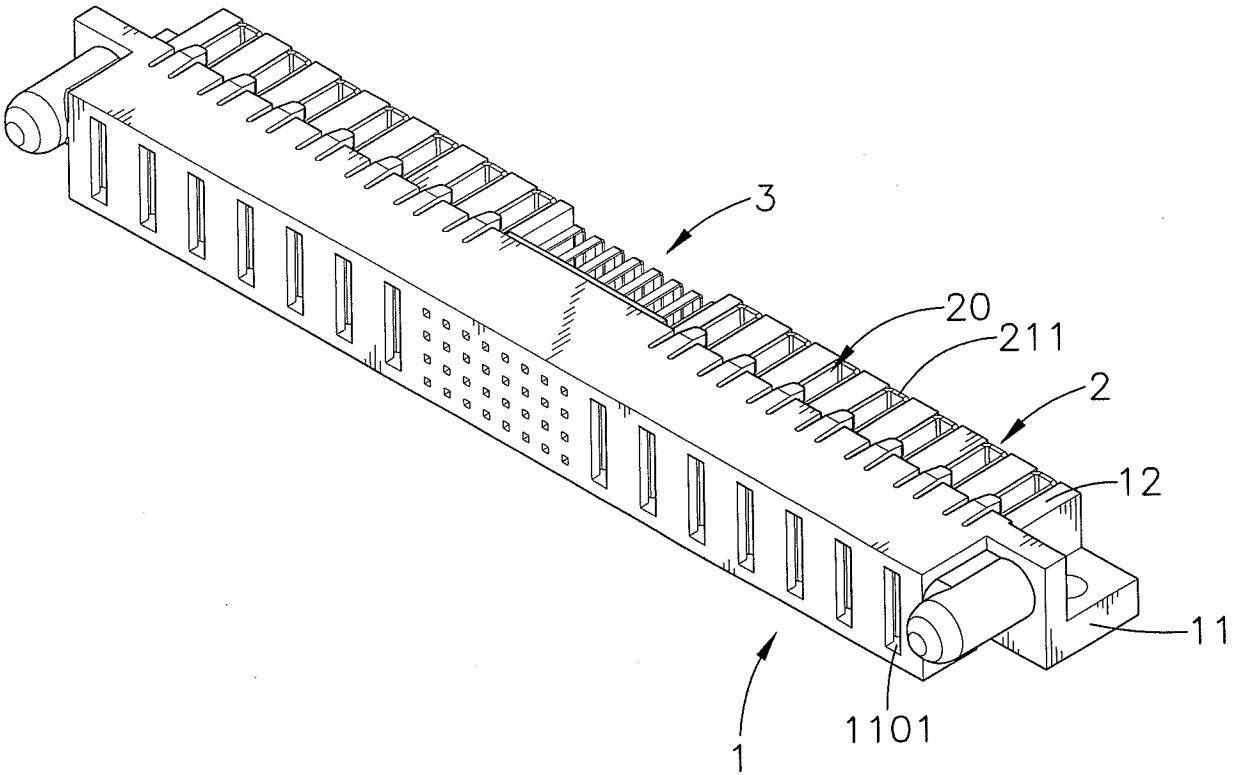
FIG. 5 is an elevational view of an electrical socket connector in accordance with the present invention.
Figure 6:
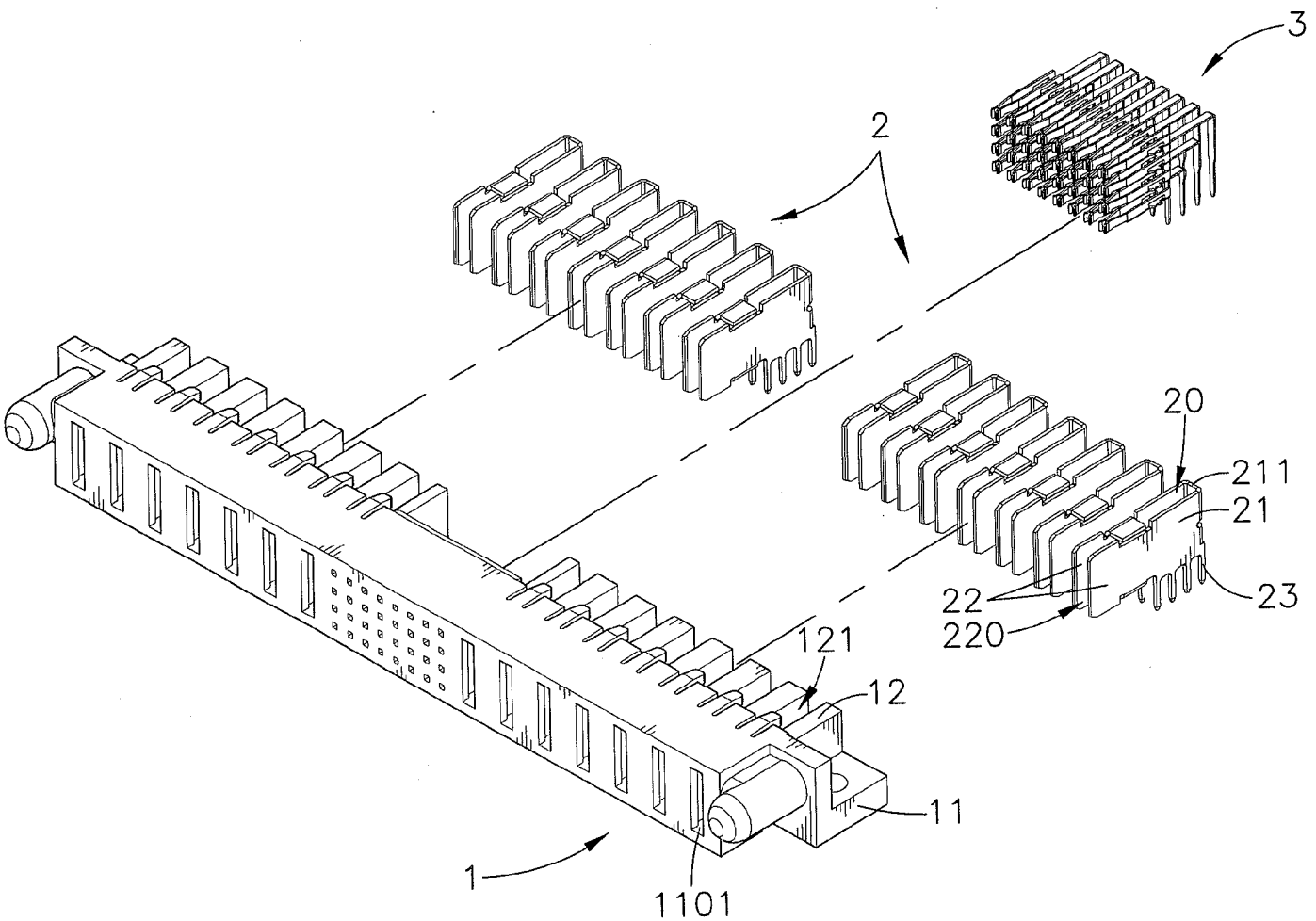
FIG. 6 is an exploded view of the electrical socket connector in accordance with the present invention.
Figure 7:
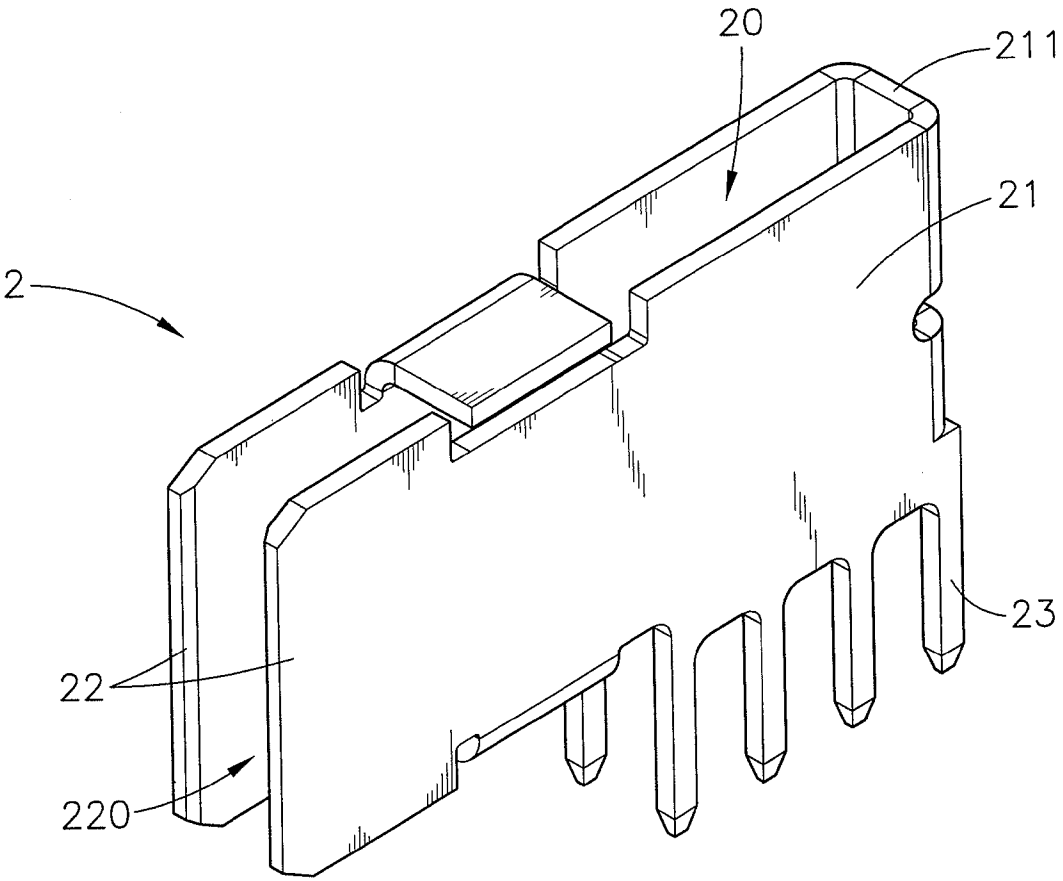
FIG. 7 is an elevational view of one conducting terminal used in the electrical socket connector in accordance with the present invention.
Figure 8:
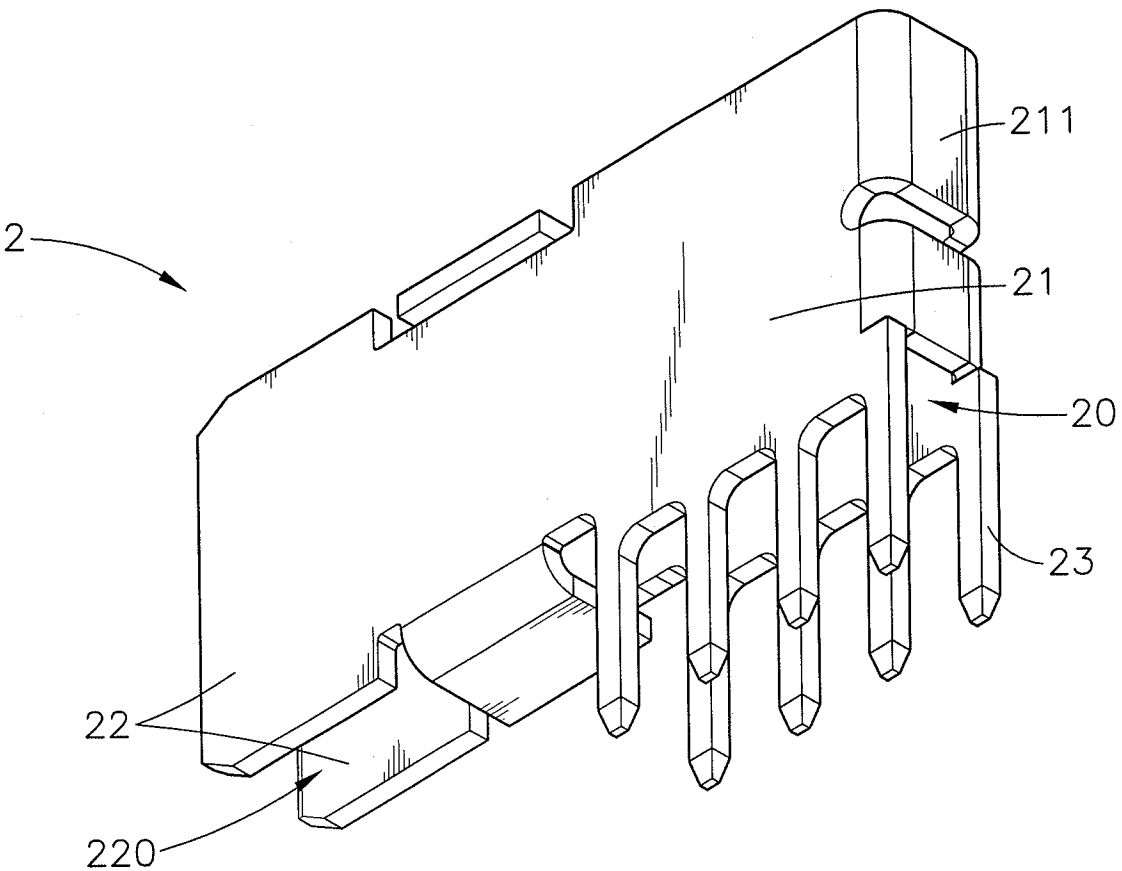
FIG. 8 corresponds to FIG. 7 when viewed from another angle.

Referring to FIGS. 1, 2, 3 and 4, an electrical plug connector in accordance with the present invention is shown comprising an electrically insulative housing 1, and a plurality of conducting terminals 2.

The electrically insulative housing 1 comprises a mating portion 11, a receiving chamber 110 defined in one side of the mating portion 11, a plurality of partition plates 12 arranged in two sets at an opposite side of the mating portion 11, a plurality of insertion slots 121 respectively defined between each two adjacent partition plates 12 of each of the two sets of partition plates 12, and a plurality of terminal holes 1101 formed in the mating portion 11 and respectively disposed in communication between the insertion slots 121 and the receiving chamber 110.

The conducting terminals 2 are respectively mounted in the insertion slots 121 of the electrically insulative housing 1. Each conducting terminal 2 comprises two side panels 21 arranged in a substantially parallel manner and defining therebetween a gap 20, a connection portion 211 connected between one end of each of the two side panels 21, two contact end portions 22 respectively forwardly extended from respective opposite ends of the two side panels 21 and engaged into one respective terminal hole 1101, and a plurality of bonding pegs 23 respectively downwardly extended from respective bottom edges of the side panels 21. Further, each contact end portion 22 defines a rear inflection surface 221 obliquely inwardly extended from the associating side panel 21, a middle planar surface 222 forwardly extended from the rear inflection surface 221, and an inwardly inclined front guide surface 223 inwardly extended from a front side of the middle planar surface 222 opposite the rear inflection surface 221.

Referring to FIGS. 5, 6, 7 and 8, an electrical socket connector in accordance with the present invention is shown comprising an electrically insulative housing 1, and a plurality of conducting terminals 2.

The electrically insulative housing 1 comprises a mating portion 11, a plurality of partition plates 12 arranged in two sets at a rear side of the mating portion 11, a plurality of insertion slots 121 respectively defined between each two adjacent partition plates 12 of each of the two sets of partition plates 12, and a plurality of terminal holes 1101 formed in a front side of the mating portion 11 and respectively disposed in communication with the insertion slots 121.

The conducting terminals 2 are respectively mounted in the insertion slots 121 of the electrically insulative housing 1. Each conducting terminal 2 comprises two side panels 21 arranged in a substantially parallel manner and defining therebetween a gap 20, a connection portion 211 connected between respective rear ends of the two side panels 21, two contact end portions 22 respectively forwardly extended from respective front ends of the two side panels 21 and inserted into one respective terminal hole 1101, a receiving space 220 defined between the two contact end portions 22 in communication with the gap 20 between the two side panels 21 for receiving one respective conducting terminal of a mating electrical plug connector, and a plurality of bonding pegs 23 respectively downwardly extended from respective bottom edges of the side panels 21.

Figure 9:
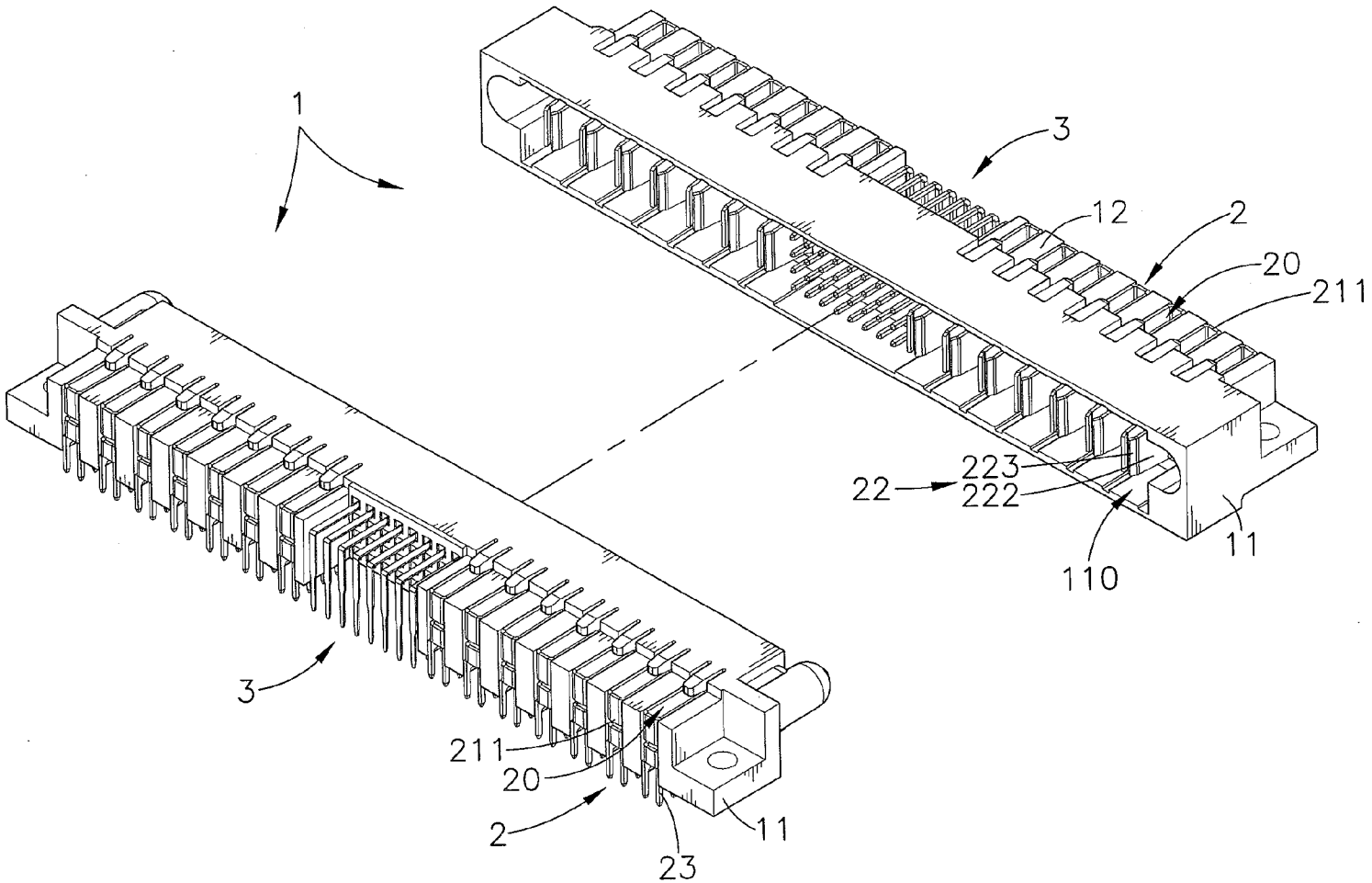
FIG. 9 is an exploded view of an electrical plug connector and an electrical socket connector of an electrical plug and socket connector assembly in accordance with the present invention.
Figure 10:
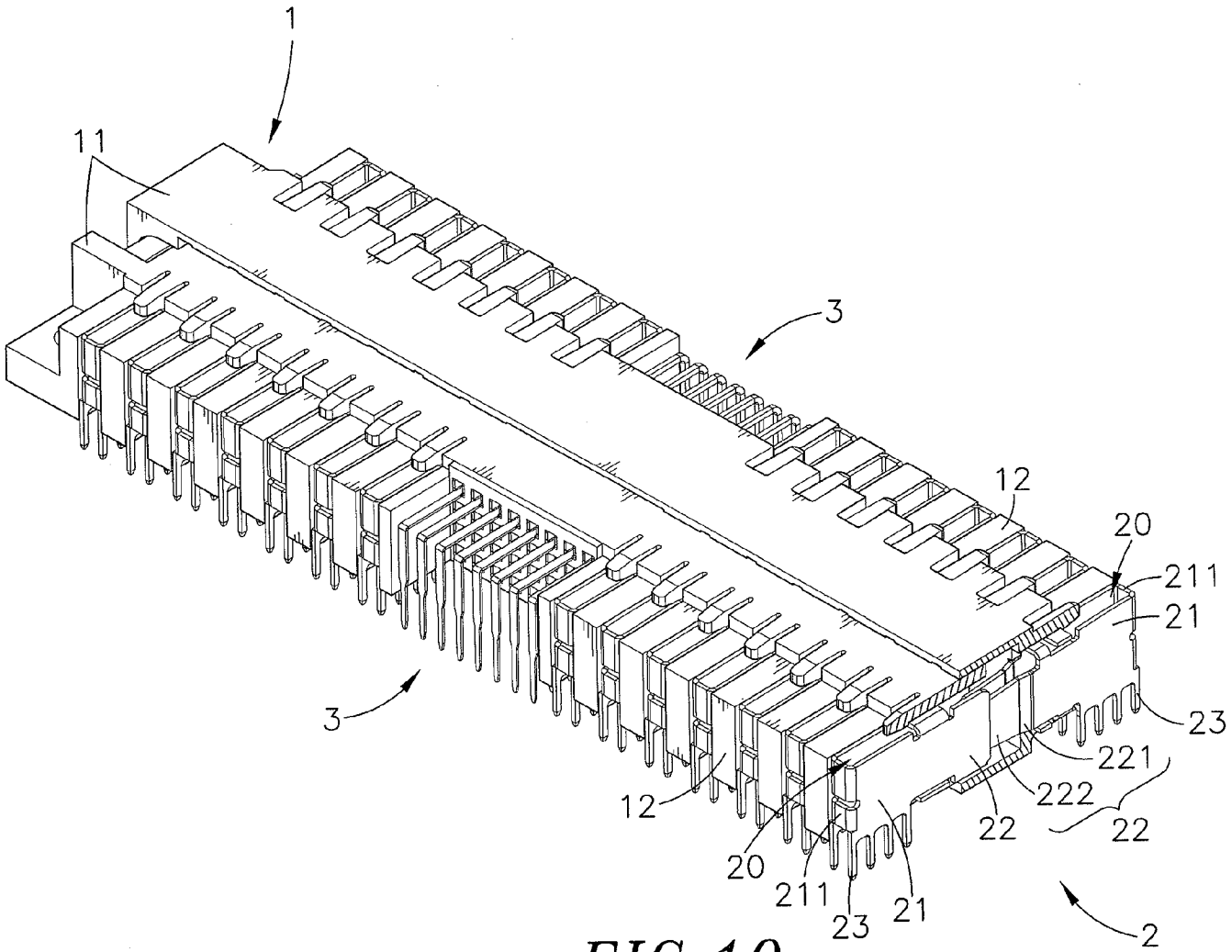
FIG. 10 is an assembly view of the electrical plug and socket connector assembly in accordance with the present invention.
Figure 11:
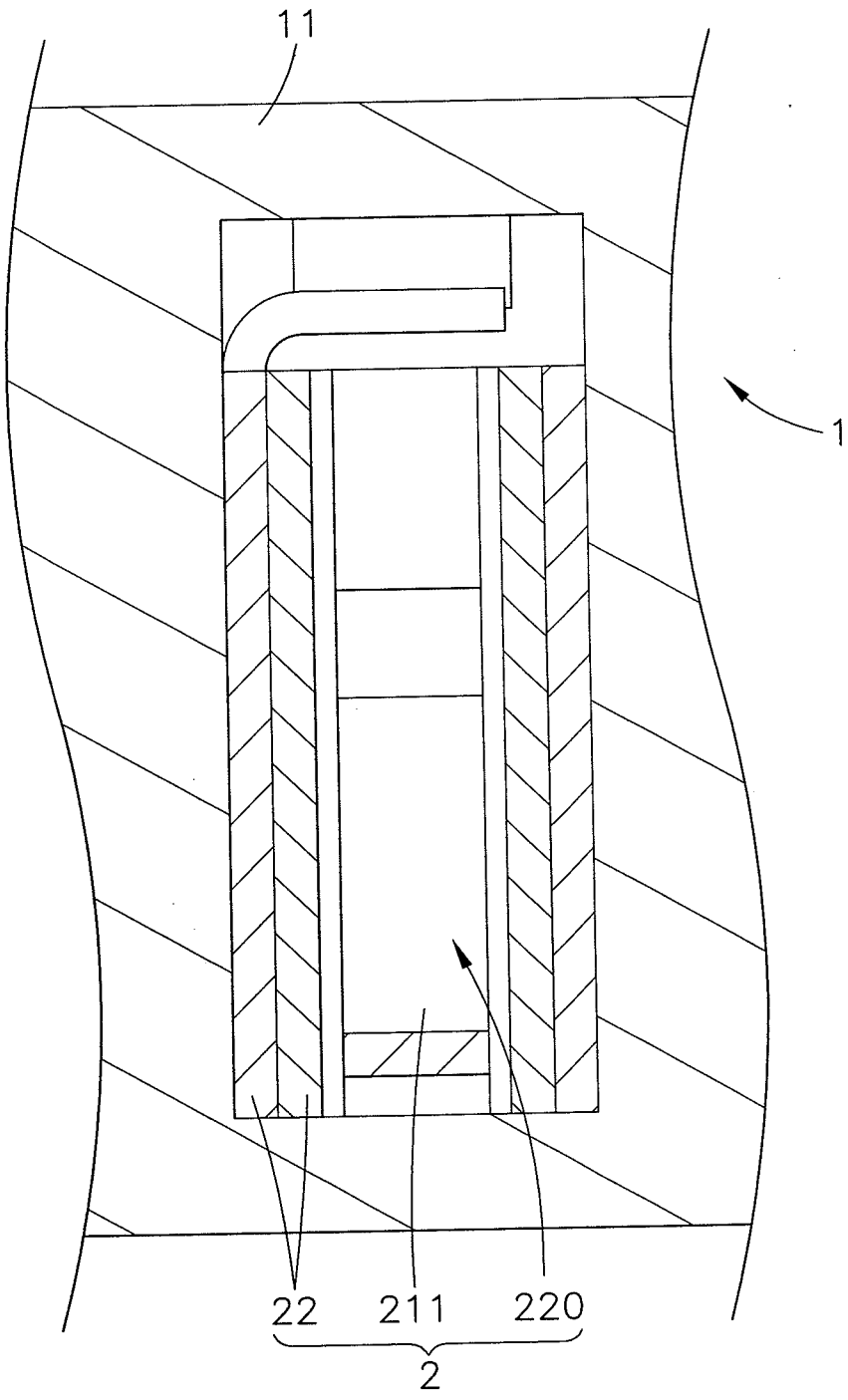
FIG. 11 is a schematic sectional view, in an enlarged scale, of a part of the electrical plug and socket connector assembly in accordance with the present invention.
Figure 12:
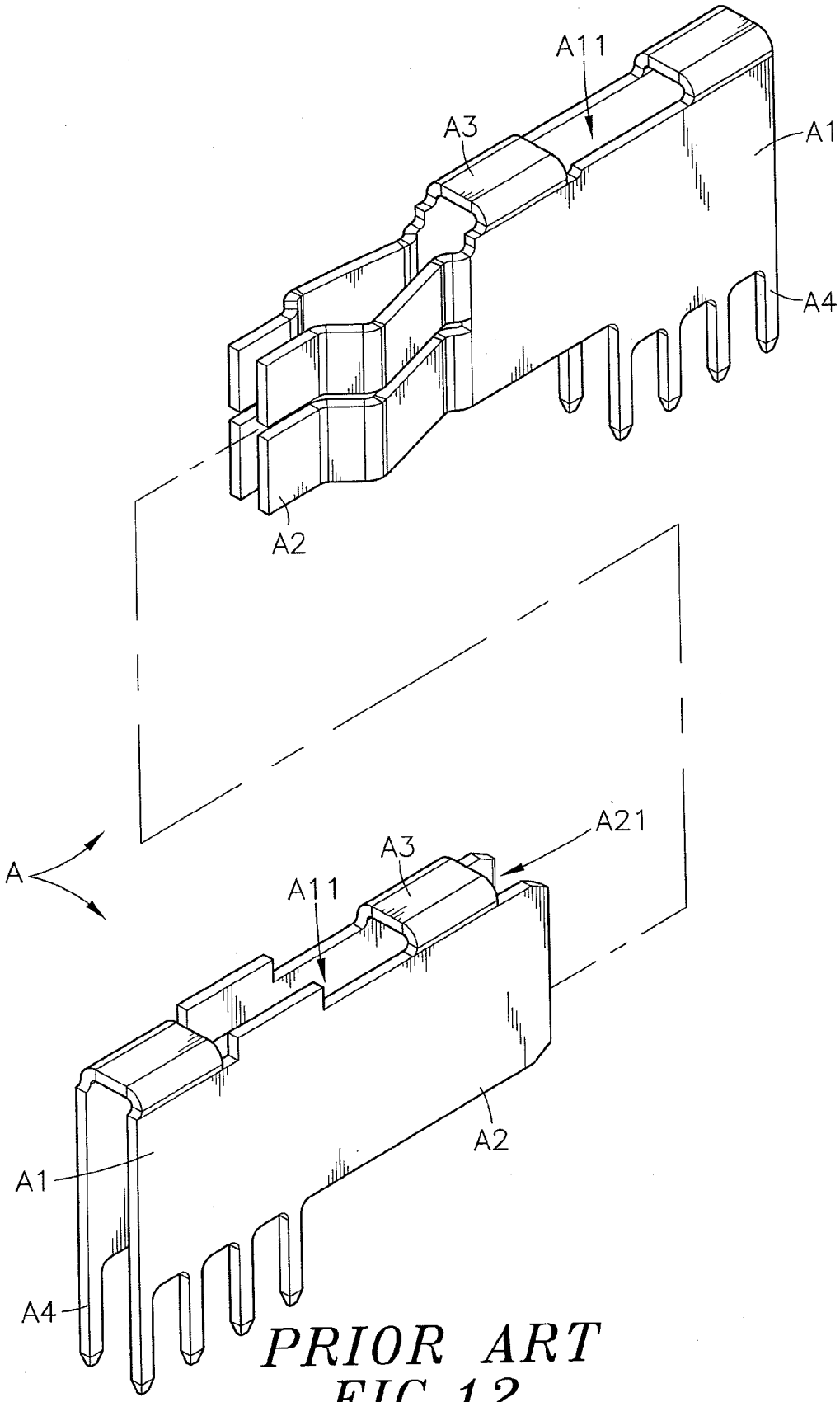
PRIOR ART FIG. 12
FIG. 12 is an exploded view of a conducting terminal for electrical plug connector and a mating conducting terminal for electrical socket connector according to the prior art.
Figure 13:
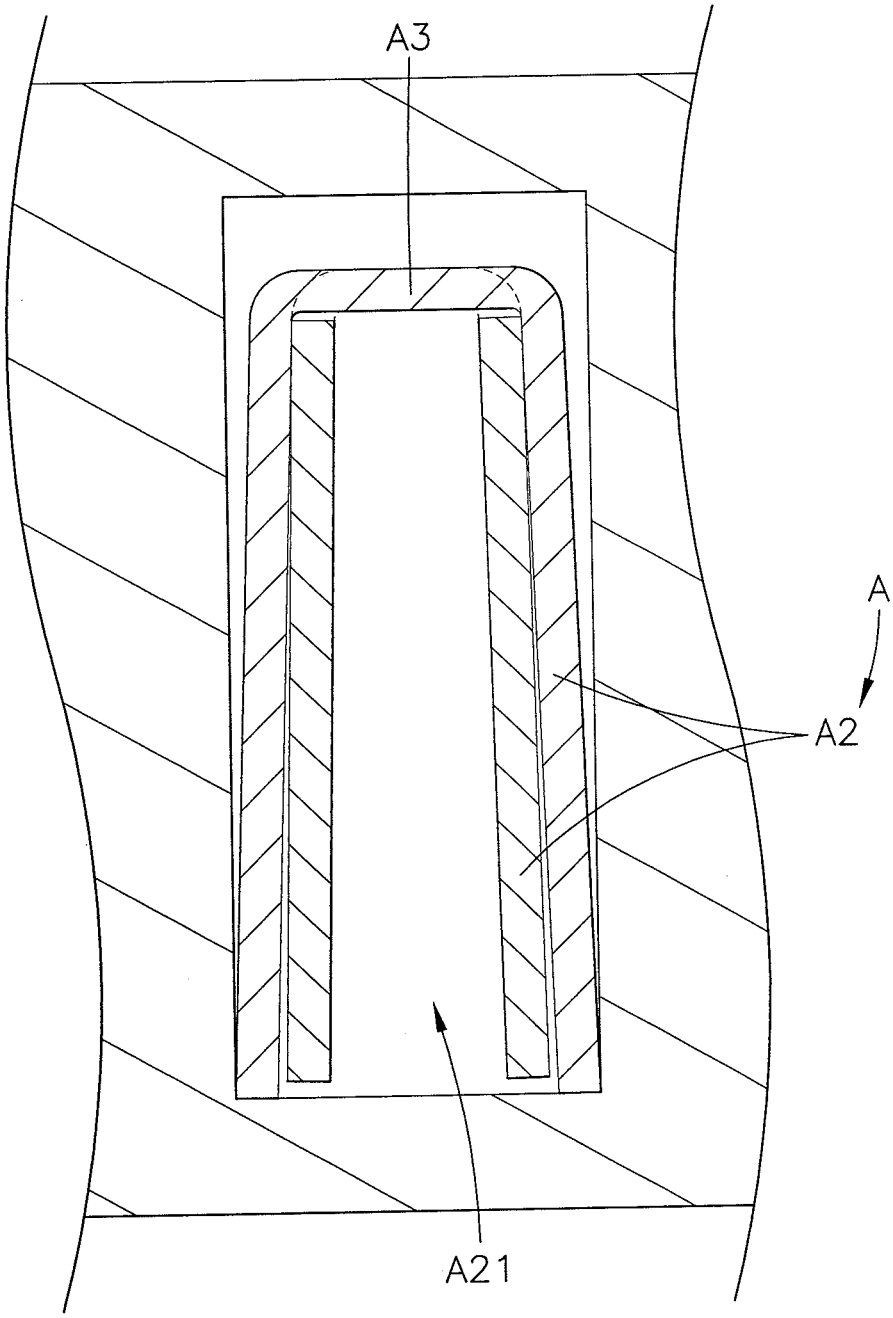
PRIOR ART FIG. 13
FIG. 13 is a schematic sectional view illustrating the conducting terminal for electrical plug connector and the mating conducting terminal for electrical socket connector connected together according to the prior art.

Referring to FIGS. 9, 10 and 11, when connecting the aforesaid electrical plug connector and electrical socket connector, insert the conducting terminals 2 of the electrical plug connector into the respective receiving spaces 220 in the conducting terminals of the electrical socket connector to force the inwardly inclined front guide surfaces 223 and middle planar surfaces 222 of the contact end portions 22 of each conducting terminal 2 of the electrical plug connector through the receiving space 220 into the gap 20 between the two side panels 21 of the respective conducting terminal of the electrical socket connector and kept in close contact with the inner surfaces of the two side panels 21 of the respective conducting terminal of the electrical socket connector. At this time, the connection portions 211 of the conducting terminals 2 of the electrical plug connector and the connection portions 211 of the conducting terminals 2 of the electrical socket connector support the associating side panels 21 and contact end portions 22, enabling the produced contact stress to be evenly distributed through the respective side panels 21. Further, the structural design that the connection portion 211 is connected between the rear ends of the side panels 21 opposite to the associating contact end portions 22 enables the middle planar surfaces 222 of the contact end portions 22 to be kept in a substantially parallel manner. Thus, the middle planar surfaces 222 of the contact end portions 22 of each conducting terminal 2 of the electrical plug connector can be kept in positive contact with the inner surfaces of the contact end portions 22 and side panels 21 of the mating conducting terminal of the mating electrical socket connector, lowering the impedance and temperature, smoothing conduction of power supply and assuring a high level of safety.

The electrical plug connector and the electrical socket connector are respectively formed of a substantially similar electrical insulative housing 1 and substantially similar conducting terminals 2 with the exceptions of the configuration of the receiving chamber 110 of the electrical insulative housing 1, the configuration of the contact end portions 22 of the conducting terminals 2. Thus, wherever possible, like reference numbers are used in the drawings and the description to refer to like parts.

Referring to FIGS. 2, 5, 9, 10 and 11 again, when a high heat is developed upon conduction of a high-current power supply through the conducting terminals 2, developed heat can be quickly dissipated through the respective gaps 20 in the insertion slots 121 into the atmosphere. Further, subject to the operation of an electric fan to create a cooling current of air through the connected electrical plug connector and electrical socket connector, the conducting terminals 2 are maintained within a predetermined operating temperature range, avoiding a significant change in the electrical characteristics of the conducting terminals 2.

The aforesaid electrical plug connector and electrical socket connector each further comprise a plurality of signal terminals 3 for transmitting data signals. As the signal terminals 3 are not within the spirit and scope of the invention, not further detailed description will be provided.

Further, the connection portion 211 of each conducting terminal 2 can be of a single piece or multiple pieces.

The main feature of the conducting terminals 2 is the design of the connection portion 211 that is connected between the rear ends of the side panels 21 opposite to the associating contact end portions 22. Subject to the design of connection portion 211, the middle planar surfaces 222 of the contact end portions 22 of each conducting terminal 2 of the electrical plug connector can be kept in positive contact with the inner surfaces of the contact end portions 22 and side panels 21 of the mating conducting terminal of the mating electrical socket connector, lowering the impedance and temperature, smoothing conduction of power supply and assuring a high level of safety.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical plug connector, comprising:

an electrically insulative housing comprising a mating portion, a receiving chamber defined in one side of said mating portion, a plurality of partition plates arranged in two sets at an opposite side of said mating portion, a plurality of insertion slots respectively defined between each two adjacent said partition plates of each of said two sets of partition plates, and a plurality of terminal holes formed in said mating portion and respectively disposed in communication between said insertion slots and said receiving chamber; and a plurality of conducting terminals respectively mounted in said insertion slots of said electrically insulative housing, each said conducting terminal comprising two side panels arranged in a substantially parallel manner and defining therebetween a gap, a connection portion connected between one end of each of said two side panels, two contact end portions respectively forwardly extended from respective opposite ends of said two side panels and engaged into one respective terminal hole, and a plurality of bonding pegs respectively downwardly extended from respective bottom edges of said side panels;

wherein each contact end portion of each said conducting terminal defines a rear inflection surface obliquely inwardly extended from the associating said side panel, a middle planar surface forwardly extended from said rear inflection surface, and an inwardly inclined front guide surface inwardly extended from a front side of said middle planar surface opposite to said rear inflection surface.

2. The electrical plug connector as claimed in claim 1, wherein the connection portion of each said conducting terminal is formed of multiple pieces.

3. An electrical socket connector, comprising:

an electrically insulative housing comprising a mating portion, a plurality of partition plates arranged in two sets at a rear side of said mating portion, a plurality of insertion slots respectively defined between each two adjacent said partition plates of each of said two sets of partition plates, and a plurality of terminal holes formed in a front side of said mating portion and respectively disposed in communication with said insertion slots; and a plurality of conducting terminals respectively mounted in said insertion slots of said electrically insulative housing, each said conducting terminal comprising two side panels arranged in a substantially parallel manner and defining therebetween a gap, a connection portion connected between respective rear ends of said two side panels, two contact end portions respectively forwardly extended from respective front ends of said two side panels and inserted into one respective said terminal hole, a receiving space defined between said two contact end portions in communication with said gap between said two side panels for receiving one respective conducting terminal of a mating electrical plug connector, and a plurality of bonding pegs respectively downwardly extended from respective bottom edges of said side panels;

wherein the connection portion of each said conducting terminal is formed of multiple pieces.

4. An electrical plug and socket connector assembly, comprising an electrical plug connector and an electrical socket connector, wherein:

said electrical plug connector comprises:

an electrically insulative housing comprising a mating portion, a receiving chamber defined in one side of the mating portion, a plurality of partition plates arranged in two sets at an opposite side of the mating portion, a plurality of insertion slots respectively defined between each two adjacent partition plates of each of the two sets of partition plates, and a plurality of terminal holes formed in the mating portion and respectively disposed in communication between the insertion slots and the receiving chamber; and a plurality of conducting terminals respectively mounted in the insertion slots of the electrically insulative housing of said electrical plug connector, each conducting terminal of electrical plug connector comprising two side panels arranged in a substantially parallel manner and defining therebetween a gap, a connection portion connected between one end of each of the two side panels, two contact end portions respectively forwardly extended from respective opposite ends of the two side panels and engaged into one respective terminal hole of the electrically insulative housing of the electrical plug connector, and a plurality of bonding pegs respectively downwardly extended from respective bottom edges of the side panels;

said electrical socket connector comprises:

an electrically insulative housing comprising a mating portion, a plurality of partition plates arranged in two sets at a rear side of the mating portion, a plurality of insertion slots respectively defined between each two adjacent partition plates of each of the two sets of partition plates, and a plurality of terminal holes formed in a front side of the mating portion and respectively disposed in communication with the insertion slots; and a plurality of conducting terminals respectively mounted in the insertion slots of the electrically insulative housing of said electrical socket connector, each conducting terminal of said electrical socket connector comprising two side panels arranged in a substantially parallel manner and defining therebetween a gap, a connection portion connected between respective rear ends of the two side panels, two contact end portions respectively forwardly extended from respective front ends of the two side panels and inserted into one respective terminal hole of the electrically insulative housing of the electrical socket connector, a receiving space defined between the two contact end portions in communication with the gap between the two side panels for receiving one respective conducting terminal of a mating electrical plug connector, and a plurality of bonding pegs respectively downwardly extended from respective bottom edges of the side panels.

5. The electrical plug and socket connector assembly as claimed in claim 4, wherein the connection portion of each conducting terminal of said electrical plug connector is formed of multiple pieces.

6. The electrical plug and socket connector assembly as claimed in claim 4, wherein the connection portion of each conducting terminal of said electrical socket connector is formed of multiple pieces.

* * * * *